United States Patent [19]

Yamamoto et al.

[11] Patent Number: 4,717,854

[45] Date of Patent: Jan. 5, 1988

[54] IMAGE PICK-UP TUBE TARGET

[75] Inventors: Masanao Yamamoto; Eisuke Inoue, both of Mobara; Keiichi Shidara, Tama; Eikyuu Hiruma, Komae, all of Japan

[73] Assignees: Hitachi, Ltd.; Nippon Hoso Kyokai, both of Tokyo, Japan

[21] Appl. No.: 830,714

[22] Filed: Feb. 19, 1986

[30] Foreign Application Priority Data

Feb. 20, 1985 [JP] Japan ..... 60-30392

[51] Int. Cl.[4] ..... H01J 31/26; H01J 31/38

[52] U.S. Cl. ..... 313/366; 313/386

[58] Field of Search ..... 313/366, 386

[56] References Cited

U.S. PATENT DOCUMENTS 4,563,611 1/1986 Nonaka et al. ..... 313/366

*Primary Examiner*—Palmer C. DeMeo

*Attorney, Agent, or Firm*—Antonelli, Terry & Wands

[57] ABSTRACT

An image pick-up tube target comprising an N-type conductive film formed on a transparent substrate, and P-type photoconductive film in rectifying contact with the N-type conductive film and comprising a first layer containing As, fluoride and Se, a second layer containing As, Te and Se, a portion of said second layer containing fluoride, a third layer containing As and Se, the composition of the third layer being different along the direction of thickness thereof, a fourth layer containing As and Se, wherein the concentration of As in the second layer varies continuously along the direction of thickness thereof, and in the second layer the minimum As concentration is located on the first layer side of the second layer and the maximum As concentration is located on the third layer side of the second layer.

4 Claims, 6 Drawing Figures

IMAGE PICK-UP TUBE TARGET

BACKGROUND OF THE INVENTION

This invention relates to image pick-up tube targets and, more particularly, to an image pick-up tube target capable of effectively suppressing sticking of images.

As is known in the art, amorphous selenium (Se) has photoconductivity and when it is combined with a signal electrode of "N" conductivity type a photodiode type photoconductive target is provided. Since Se is not sensitive to long wavelength radiation, it has been proposed to add Te into a portion of the Se-containing layer in order to improve the sensitivity to long wavelength radiation. This method is disclosed in U.S. Pat. No. 3,890,525 to Hirai et al. and U.S. Pat. No. 4,040,985 To Shidara et al.

FIG. 1 shows a basic structure of a typical target of the prior art, such as that disclosed in the U.S. Pat. No. 4,040,985. In FIG. 1, numeral 1 designates a transparent substrate, numeral 2 designates a transparent N-type conductive layer, and numeral 3 designates the first P-type photoconductive layer which corresponds to a sensitized portion of a P-type photoconductive film. Numeral 4 denotes the second P-type conductive layer which serves to reduce an electrostatic capacitance of the target, and numeral 5 denotes a beam landing layer for assisting landing of a scanning electron beam.

The first P-type photoconductive layer 3 may be made of Se, As and Te and the region where the signal current is generated by conversion of light energy into electrical current for the most part and FIG. 2 shows an example of concentration distribution in the direction of thickness from the transparent N-type conductive layer side of the first P-type photoconductive layer 3 shown in FIG. 1. In the illustrated example, sensitizing Te does not exist at zero level of the film thickness (region a) corresponding to the interface with the transparent conductive layer 2, and the concentration of Te rapidly increases from a 100 nm level of the film thickness and Te is added over the thickness of 150 nm (region b). The element As is added in the regions a and b to enhance the thermal stability of Se. Region c is added with As which is considered to form deep levels in the energy gap to enhance the effect of sensitization. The concentration of As decreases at a uniform rate over the film thickness of 250 nm. This As also serves to enhance the thermal stability of Se. The target which has the structure of this type attains an object for increasing sensitivity to long wavelength radiation.

The second P-type photoconductive layer 4 may be made of Se and As which is added to enhance the thermal stability of Se, is thick enough to minimize electrostatic capacitance which causes capacitive lag, and constitutes most of the thickness of the photoconductive target.

The beam landing layer 5 may be made of $Sb_2S_3$, and forms a porous layer by being evaporated in low vacuum while the first and second P-type photoconductive layers 3 and 4 usually form glassy layers by being evaporated in high vacuum.

The image pickup tube of this type exhibits good characteristics to the ordinary requirements for image pick-up tubes such as lag and after-image. A part from the above, it has been proposed to dope a small amount of halogen in order to improve the lag and the afterimage of the target used in a pickup tube whose main component is Se and which utilizes rectifying contact.

This method is disclosed in U.S. Pat. No. 3,984,722 to Maruyama et al. The target of this type exhibits good characteristics in ordinary usage condition, but if the intensity of incident light becomes considerably higher than during a normal usage condition, the response after the incident light has been cut off (lag for intense light) is deteriorated. The longer the operating time becomes, the more deteriorated this response is. The normal usage condition used herein is determined as the condition in which the intensity of the incident light is such that it produces a signal current output of approximately 0.2 $\mu$Ap-p. The intensity of the light used herein is roughly 20 times as high as that of the normal usage condition, although the value is not defined critically. The lag resulting from such an intense light is usually referred to as "high light sticking." In order to minimize the high light sticking, it has been proposed to dope at least one kind of metal fluoride selected from a group consisting of LiF, NaF, $MgF_2$, $CaF_2$, $BaF_2$, $AlF_3$, $CrF_3$, $MnF_2$, $CoF_2$, $PbF_2$, $CeF_3$ and TlF into the region where the signal current is generated for the most part. This method is disclosed in U.S. Pat. No. 4,330,733 to Shidara et al.

However, when a stationary scene is viewed continuously for a long time with an image pick-up tube having the above-mentioned target, a so-called sticking phenomenon occurs wherein a previously viewed image sticks and superposes on a presently viewed image. Physical mechanism of this sticking may be explained as follows. Photogenerated carriers produced in illuminated areas of the target are captured in carrier traps of the photoconductive layer, form space charges, modify internal electric field across the layer, and modulate sensitivity of the target locally while in non-illuminated areas of the target, an electric field across the photoconductive layer is uniform over the entire areas and determined by voltage applied from an external power source. The difference between the sensitivity of previously illuminated areas and that of previously non-illuminated areas results in sticking.

Japanese Unexamined Patent Publication (Kokai) No. SHO 57 (1982)-80637 corresponding to U.S. Pat. No. 4,563,611 discloses a method in which fluoride is doped over a region where the signal current is generated for the most part for the purpose of promoting recombination of carriers.

However, in the target constructed in accordance with the above-mentioned patent, in a region where Te is doped in order to enhance sensitivity to long wavelength radiation, space charges due to trapping of photogenerated carriers modify the internal electric field across the photoconductive layer locally and decrease an amount of photocurrent to be drawn therefrom. This shifts photocurrent-voltage characteristic curves toward higher voltage and causes difference between sensitivity of previously illuminated areas and that of previously non-illuminated areas and results in sticking.

SUMMARY OF THE INVENTION

It is, therefore, an object of the present invention to provide an image pick-up tube target capable of improving sticking characteristics and having desired photocurrent voltage characteristics.

To attain this object, according to the invention, the concentration distribution of As is graded in a Te-containing layer in such a manner that the concentration of As is substantially increased as the distance from the transparent electrode increases.

DETAILED DESCRIPTION OF THE PREFERRED EMBODIMENTS

Figure 1:
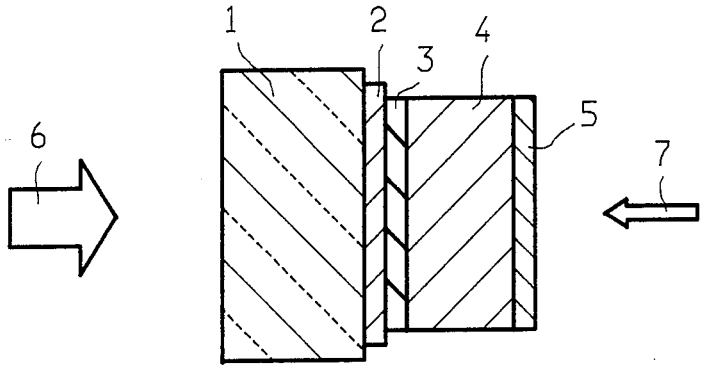
FIG. 1 shows a sectional view of a target used in an image pick-up tube target.
Figure 2:
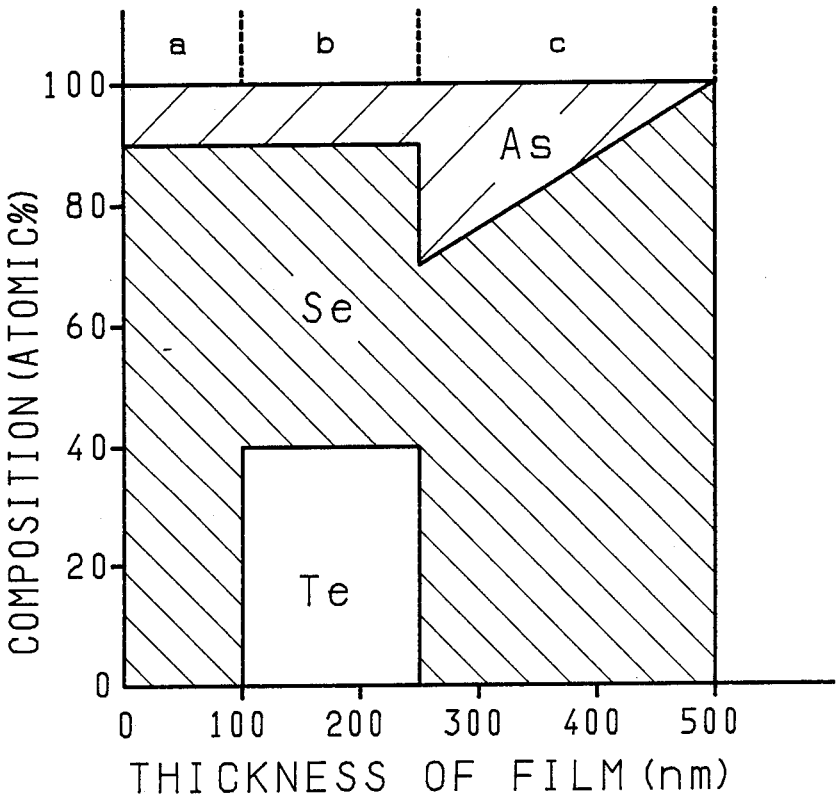
FIG. 2 PRIOR ART
FIG. 2 shows a concentration distribution at a major portion of a target of the prior art.
Figure 3:
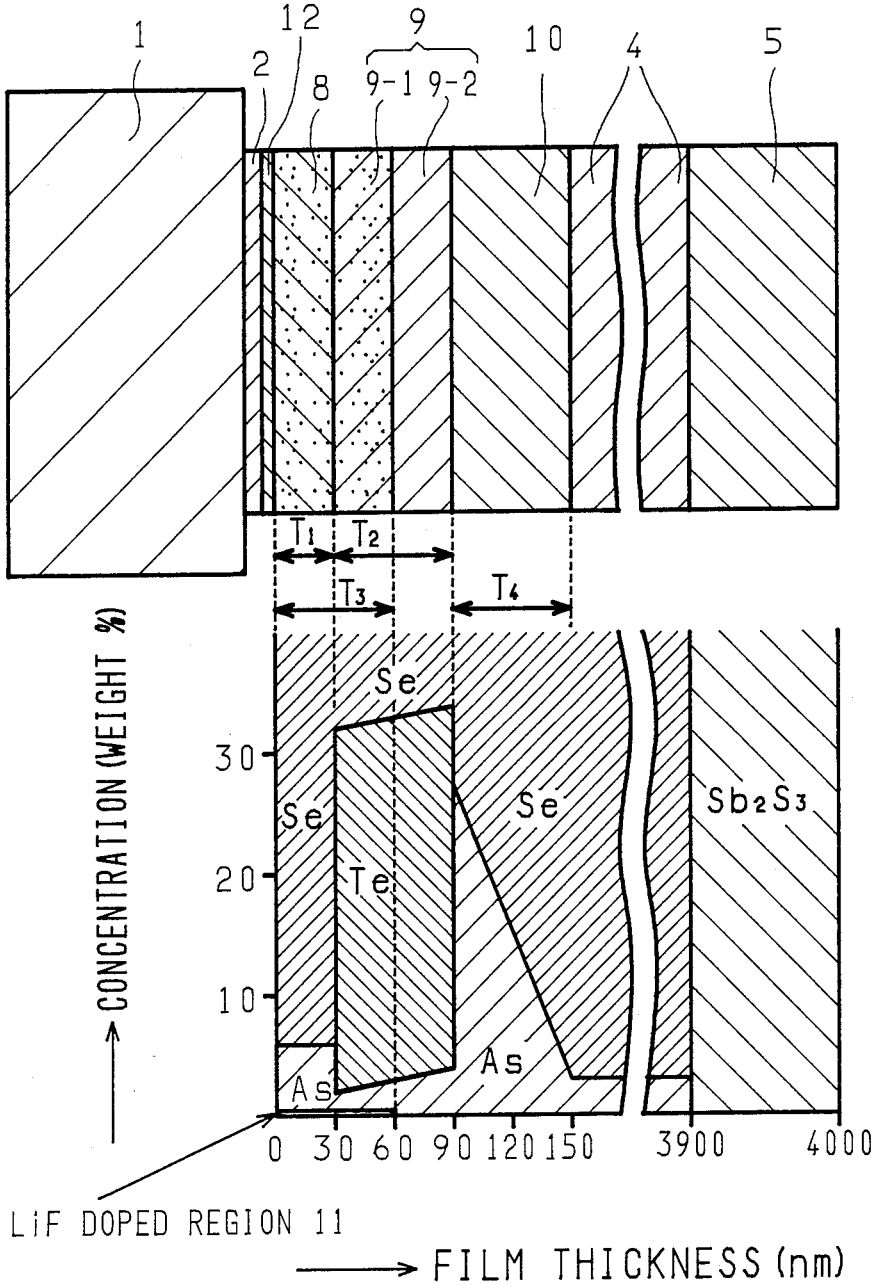
FIG. 3 illustrates a schematic view, in section and not to scale, along with a concentration distribution diagram, showing one embodiment of the image pick-up tube target according to the invention.

FIG. 3 illustrates a sectional view, along with a concentration distribution diagram, showing one embodiment of the image pick-up tube target according to the invention. The same reference numerals as in FIG. 1 denote the same parts as in FIG. 1, and a detailed description thereof will be omitted.

A transparent electrode 2 mainly composed of, for instance, $SnO_2$ is formed on a glass substrate 1 which is made of a transparent material. A very thin transparent N-type conductive film 12 composed of, for example, CeO is formed on the upper surface of the transparent electrode 2. A first layer 8 of a P-type photoconductive film consisting of a P-type amorphous semiconductor of a Se-As-LiF system containing 0.01 to 3.0% by weight of LiF, 8±4% by weight of As and the remainder of Se is formed to a thickness of $T_1=30\pm3$ nm on the N-type transparent film 12, and a second layer 9 of the P-type photoconductive film of Se-As-Te-LiF system comprising a sublayer 9-1 of 30 nm thickness containing 0.01 to 3.0% by weight of LiF, As of initially 1.5±0.5% by weight and smoothly increased to 2.8±1% by weight at the end of the sublayer 9-1, 30±10% by weight of Te and the remainder of Se, and sublayer 9-2 of 30 nm thickness containing As of initially 2.8±1% by weight and smoothly increased to 4±2% by weight at the end of the sublayer 9-2 is formed to a thickness $T_2=60\pm6$ nm over the upper surface of the first P-type photoconductive layer 8. LiF doped region is designated by numeral 11. A third layer 10 of the P-type photoconductive film of a Se-As system P-type amorphous semiconductor containing Se and As is formed to a thickness of $T_4=60\pm10$ nm on the second layer 9 of the P-type photoconductive film, with a concentration distribution in which a concentration of 70±1% by weight of Se and peak concentration of 25±10% by weight of As lying adjacent to the rear of the layer 9 change gradually to 97±1% by weight of Se and 3±1% by weight of As, respectively. A fourth layer 4 is formed on the third layer, containing 97±1% by weight of Se and 3±1% by weight of As to complete the P-type photoconductive film with thickness of 3760 nm. A beam landing layer 5 of $Sb_2S_3$ is vapor deposited to a thickness of about 100 nm on the layer 4.

Figure 4:
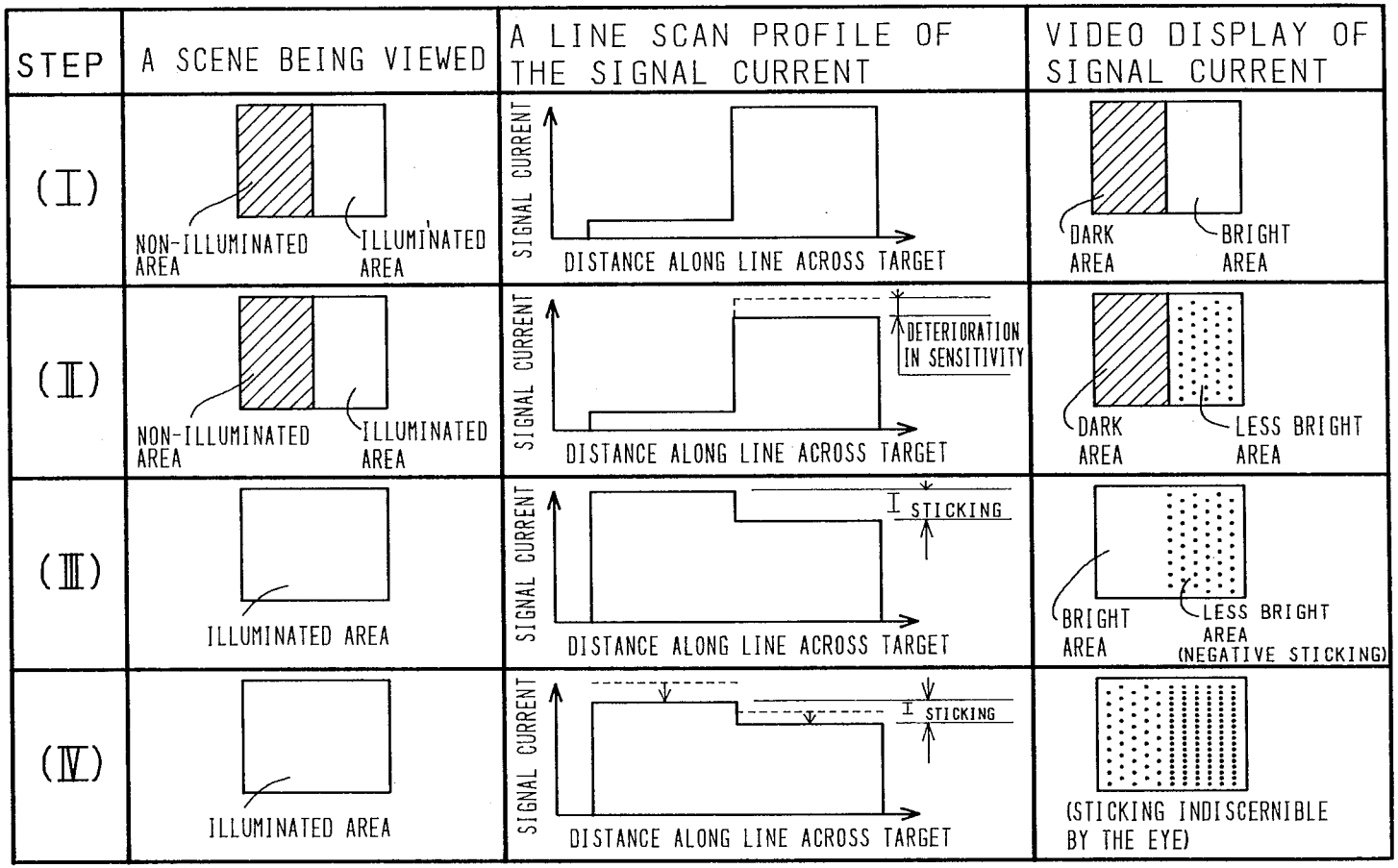
FIG. 4 illustrates the definition of sticking used here and its evaluation procedure.

The defintion of sticking used here and its evaluation procedure are illustrated in FIG. 4.

In step (I) a pattern of black and white is imaged on the target and intensity of a light source is adjusted for 0.2 μAp-p signal currents from the $6.6\times8.8$ mm$^2$ scanned area of the target.

In step (II) light is left on for 30 seconds in the same condition as in step (I). The signal current corresponding to the illuminated area of the target decreases to a certain extent.

In step (III) the entire scanned area of the target is illuminated for 0.2 μAp-p signal currents from the $6.6\times8.8$ mm$^2$ scanned area of the target. The video display of the signal currents indicates that the area which has previously been illuminated in step (II) is less bright than the area which has previously been non-illustrated, resulting in negative sticking.

Step (IV) measures the time required for sticking to decrease to a level indiscernible by the eye.

Life test experience with image pick-up targets revealed that the level of sticking varies with the lapse of the running time. The evaluation procedure of sticking is repeated at sufficient time intervals.

Figure 5:
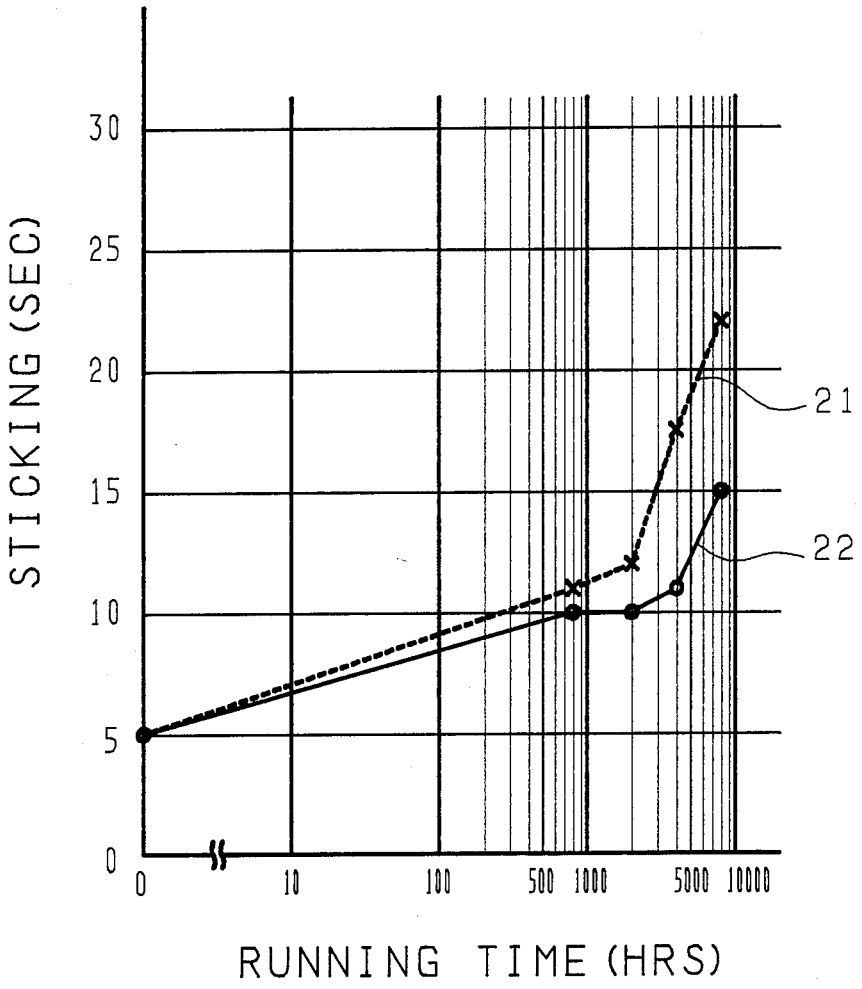
FIG. 5 graphically illustrates variations in sticking in an image pick-up tube incorporating an image pick-up tube target according to the invention in comparison with a tube of the prior art.

FIG. 5 illustrates a variation in sticking in the target of the image pick-up tube according to the invention in comparison with that of the image pick-up tube target disclosed in Japanese Unexamined Patent Publication (Kokai) No. SHO 57 (1982)-80637 corresponding to U.S. Pat. No. 4,563,611, both targets being operated for a long time duration under the same operating conditions. A broken line 21 in FIG. 5 shows a sticking characteristics of the prior art target, and it can be improved as shown by a solid line 22 in accordance with the present invention. The improvement becomes more pronounced as the running time increases.

In the image pick-up tube target having the above construction, according to the present invention, by lowering the concentration of As on the transparent electrode side of the Te-containing layer, trapping of electrons by As is reduced and no or little negative space charge is formed and therefore there is no local weakening of the internal electric field across the layer which interferes with electron transport. By increasing the concentration of As on the beam landing layer side of the Te-containing layer the internal electric field across the layer is strengthened enough to draw carriers and prevent the shift of photocurrent-voltage characteristic curves toward higher voltage during operation.

Figure 6:
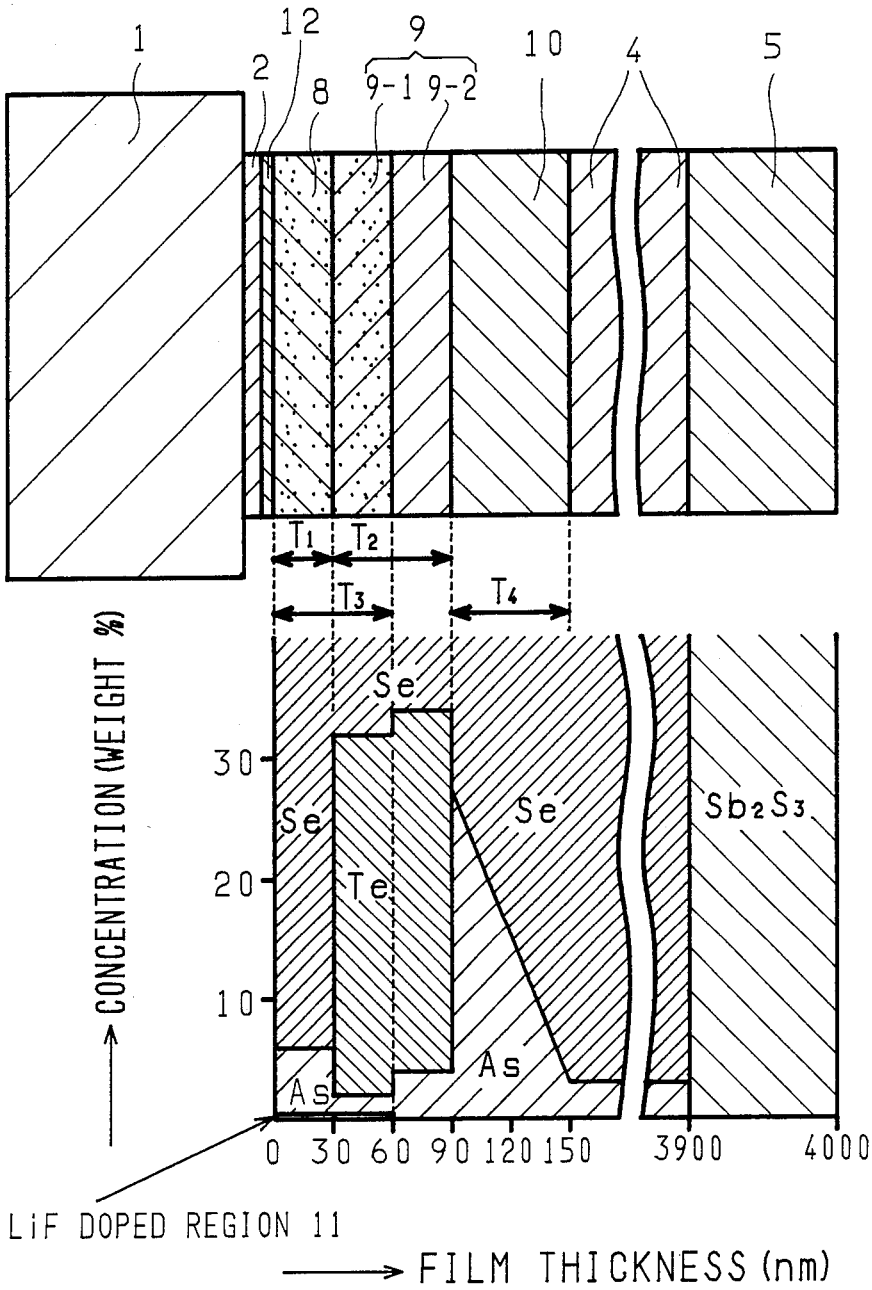
FIG. 6 illustrates a schematic view, in section and not to scale, along with a concentration distribution diagram, showing another embodiment of the image pick-up tube target according to the invention.

FIG. 6 illustrates a sectional view, along with a concentration distribution diagram, showing another embodiment of the image pick-up tube target according to the invention. In this embodiment all the layers are of the same construction as in the above-mentioned embodiment except for a second layer 9 of the P-type photoconductive film. In FIG. 6 a second layer 9 comprises a sublayer 9-1 of 30 nm thickness containing 0.4±0.2% by weight of LiF, 1.5±0.5% by weight of As, 30±10% by weight of Te and the remainder of Se, and a sublayer 9-2 of 30 nm thickness containing 4±2% by weight of As, 30±10% by weight of Te and the remainder of Se. The image pick-up tube target of this embodiment shows a sticking characteristics similar to the solid line 22 shown in FIG. 5.

The present invention is not limited to the particular embodiments described above. Various changes and modifications may be made within the spirit and scope of the invention. The preferable concentration distribution of As in the Te-containing layer is 1% minimum and 2.0% maximum by weight on the transparent electrode side of the layer and 2% minimum and 6% maximum by weight on the beam landing layer side of the layer. Preferable thickness ranges for $T_1$, $T_2$, and $T_4$ in FIGS. 3 and 6 are 15 to 45, 30 to 120, and 20 to 70 nm, respectively.

Further, while in the above embodiment LiF has been used as the fluoride doped in the photoconductive film, this is by no means limitative, and similar effects can be obtained by using at least one fluoride selected from the group consisting of NaF, $MgF_2$, $CaF_2$, $BaF_2$, $AlF_3$, $CrF_3$, $MnF_2$, $COF_2$, $PbF_2$, $CeF_3$ and TlF. It is preferable that the doping of the P-type photoconductive film with fluoride is effected from the light incident end surface of the film in the direction of the thickness of the film continuously and at a substantially uniform concentration lying within a range of from 0.01 to 3.0% by weight to a depth which is 10 to 50% of the thickness of the Te-containing layer.

As has been described in the foregoing, with the image pick-up tube target according to the invention it is possible to reduce sticking greatly and to prevent shift of photocurrent-voltage characteristic curves, thus permitting a picked-up image of high quality to be obtained.

What is claimed is:

1. An image pick-up tube target comprising an N-type conductive film formed on a transparent substrate, and a P-type photoconductive film in rectifying contact with said N-type conductive film and comprising a first layer containing As, fluoride and Se, a second layer containing As, Te and Se, a portion of said second layer containing fluoride, a third layer containing As and Se, the composition of said third layer being different along the direction of thickness thereof, a fourth layer containing As and Se, the improvement wherein the concentration of As in said second layer varies continuously along the direction of thickness thereof, and in said second layer the minimum As concentration is located on the said first layer side of the second layer and the maximum As concentration is located on the said third layer side of the second layer.

2. An image pick-up tube target according to claim 1 wherein said concentration of As varies linearly along the direction of thickness of said second layer.

3. An image pick-up tube target according to claim 1 wherein said minimum As concentration is between 1 and 2% by weight, and said maximum As concentration is between 2 and 6% by weight.

4. An image pick-up tube target according to claim 1 wherein said fluoride is LiF.

* * * * *